United States Patent [19]

Jones, Jr. et al.

[11] Patent Number: 4,461,359

[45] Date of Patent: Jul. 24, 1984

[54] ROTARY DRILL INDEXING SYSTEM

[75] Inventors: Emrys H. Jones, Jr., Butler, Pa.; Ronald W. Umphrey, Ponca City, Okla.

[73] Assignee: Conoco Inc., Ponca City, Okla.

[21] Appl. No.: 371,097

[22] Filed: Apr. 23, 1982

[51] Int. Cl.[3] ..... E21B 7/04

[52] U.S. Cl. ..... 175/61; 175/65; 175/62; 175/73

[58] Field of Search ..... 175/73, 61, 62, 65

[56] References Cited

U.S. PATENT DOCUMENTS 3,554,302 1/1971 Adkins ..... 175/73
3,595,326 7/1971 Claycomb ..... 175/73

OTHER PUBLICATIONS

"Rotary Drilling Holes in Coal Beds for Degasification," Bureau of Mines Report of Investigation 8097, U.S. Department of the Interior, 1975, Joseph Cervik et al.

*Primary Examiner*—William F. Pate, III
*Attorney, Agent, or Firm*—Richard W. Collins

[57] ABSTRACT

Rotary process and apparatus for drilling a borehole through a subterranean formation in which the path of a rotary drill bit is varied by deflecting the drill string in response to the pulsating flow of drilling fluid through the drill string. The pulsating drilling-fluid flow is synchronized with the rotation of the drill string by generating a function representative of the rotational position of the drill string and, in response to this function, diverting a portion of the drilling fluid through a secondary line. Flow through the secondary line is controlled by a valve which is opened and closed in synchronization with the rotational position of the drill string. The diverted fluid is supplied to the drilling fluid source for recirculation.

3 Claims, 8 Drawing Figures

ROTARY DRILL INDEXING SYSTEM

TECHNICAL FIELD

This invention relates to rotary drilling systems and more particularly to methods and apparatus for the drilling of boreholes in which drilling fluid is circulated in a synchronized, pulsating mode.

BACKGROUND OF THE INVENTION

In the drilling of boreholes through subterranean earth formations there are various applications in which is is desirable to control certain downhole parameters during the drilling operation. On such drilling parameter is the direction of the borehole as it is advanced through the earth's crust. Often times, if the borehole does not follow the desired course, it is necessary to deflect the borehole in the desired direction. This problem is often encountered in the coal industry where it is a common expedient to form long, generally horizontal boreholes in coal-bearing formations. These boreholes provide for the degasification of the coal formations prior to conducting mining activities. After drilling the boreholes, which are generally horizontal, i.e. generally follow the dip of the coal formation, they are vented to a suitable disposal or collection facility in order to remove hydrocarbon gas (methane) from the coal bed. It is usually desirable to drill relatively long gas-relief boreholes since the methane flow rates are directly proportional to their lengths. One difficulty encountered in drilling such holes is in maintaining the bit trajectory within the desired confines of the coal bed.

Among the systems employed in drilling gas-relief boreholes are rotary drilling systems in which the drill bit is driven by means of a rotating drill string which is connected to a suitable power source located externally of the hole. Such rotary drilling systems are similar in operation to the rotary drilling rigs employed in the drilling of oil and gas wells except that the coal drilling systems are, of course, much smaller and the drill string is rotated by a drill head incorporating a power swivel rather than by a rotary-table structure.

The use of rotary drill string systems to drill gas relief holes is disclosed in Cervik, Joseph, et al. "Rotary Drilling Holes in Coal Beds for Degasification", Bureau of Mines Report of Investigation 8097, U.S. Department of the Interior, 1975. This report describes the use of various centralizer (stabilizer) configurations in combination with bit thrust and bit rotational velocity to control the bit trajectory. Thus, the authors disclose that by placing a short centralizer immediately behind the bit, the hole will follow a slight upward arc under the appropriate conditions of thrust on the drill string and rotational speed. By locating the centralizer about 10 feet behind the bit, the drill string follows a curved path downward. Cervik et al. also disclose the use of two centralizers, one directly behind the bit and the other spaced 10 to 20 feet behind the first centralizer. In this case, the borehole also follows a slightly downward path.

Another system for guiding the advance of a rotary drill bit along a designated path which is particularly well suited to the drilling of gas-relief holes in coal-mining operations, is disclosed in U.S. patent application Ser. No. 371,098 entitled "Method and Apparatus or Rotary Drill Guidance" filed of even date herewith by Emrys H. Jones and Ronald W. Umphrey. As disclosed in the Jones and Umphrey application, the advance of the drill bit is guided along the desired path by repeatedly deflecting the drill string from its axis in a constant radial direction during rotation thereof. Deflection of the drill string is accomplished by the operation of deflector pads located in a segment of the drill pipe. The deflector pads are repeatedly projected and retracted in response to the flow of drilling fluid through the drill string in a pulsating mode which is synchronized with the rotation of the drill string.

DISCLOSURE OF THE INVENTION

In accordance with the present invention, there are provided new and improved rotary drilling processes and systems for the supply of drilling fluid to a drill string in a pulsating mode synchronized with the rotation of the drill string. The rotary drilling systems comprises a drill head having a rotary drill stem secured thereto. A supply line extends to the drill head from a source of drilling fluid. A secondary flow line having flow control means therein is connected to the supply line. The system further comprises means for generating a function representative of the rotational position of the drill stem. The flow control means acts in response to this function to vary the flow of fluid through the secondary line in synchronization with the rotational position of the drill stem.

A further aspect of the invention involves a process of drilling a borehole through a subterranean formation in which the directional advance of the drill bit is controlled by deflecting the drill string in response to pulsations in the flow of drilling fluid through the drill string. The pulsations in the drilling fluid flow are synchronized with the rotation of the drill string by establishing a flow rate of the drilling fluid supplied to the drill string, generating a function representative of the rotational position of the drill string, and in response to this function, repeatedly changing the flow of the drilling fluid in synchronization with a designated rotational position of the drill string.

BEST MODES FOR CARRYING OUT THE INVENTION

In rotary drilling operations, axial and rotational forces are imparted to the drill bit through a string of drill pipe which extends from the bit to the surface of the borehole. A drilling fluid is circulated through the well in order to remove cuttings therefrom. This is accomplished by pumping the drilling fluid into the borehole through the rotating drill string and outwardly through ports in the drill bit. The drilling fluid is then forced out of the well through the annulus surrounding the drill string. The drill cuttings are entrained in the drilling fluid and are withdrawn from the well with the fluid. The drilling fluid in addition to serving as a vehicle for the removal of cuttings, may also serve other functions such as cooling of the drill bit. Water, with and without additives, normally is employed as the drilling fluid in such operations.

In the drilling of gas relief holes preparatory to coal mining operations, the holes follow the dip of the coal bed and thus are oriented in a generally horizontal direction. In this configuration, the weight of the drill pipe provides little or no weight on the bit. The axial thrust on the bit and the rotational force are provided by means of an external prime mover. This may be of any suitable form such as the drill and power units described in the previously referred to Report of Investigations by Cervik et al. Typically, the axial thrust imposed upon the bit may range from about 500 to 3,000 pounds. The bit normally is rotated at a rate of about 200 to 1,000 revolutions per minute.

Figure 1:
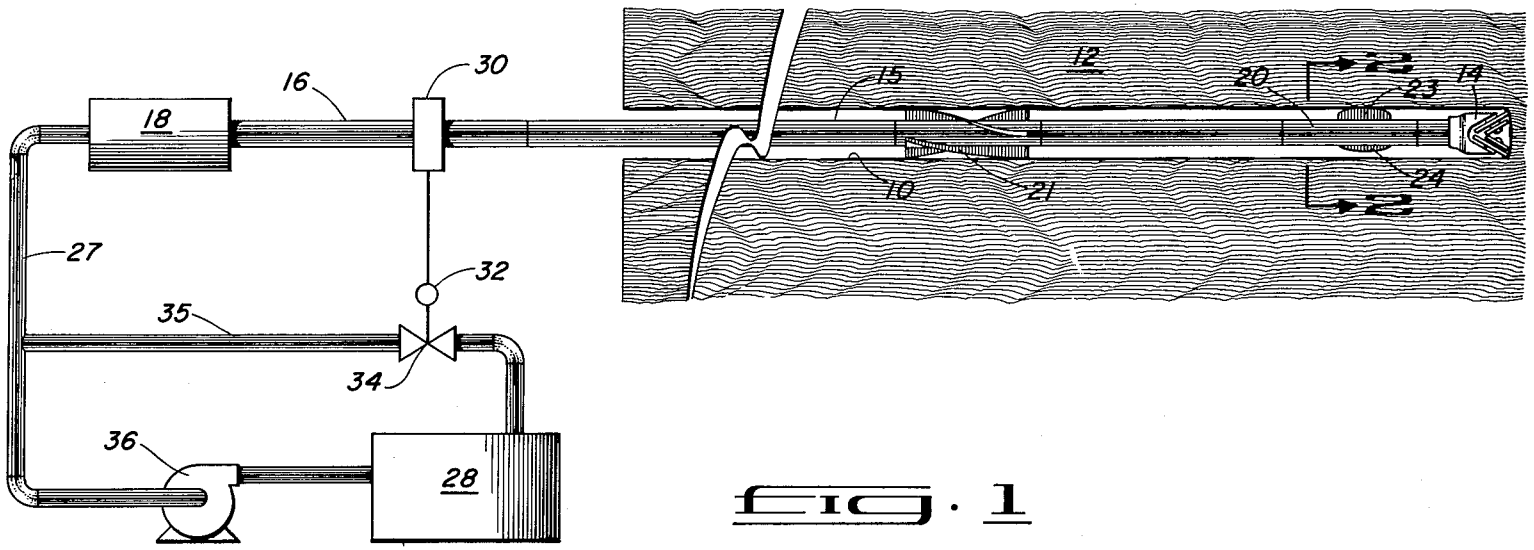
FIG. 1 is a schematic illustration of a rotary drilling system in which the invention is employed to control the directional advance of the drill bit.

As disclosed in the aforementioned application Ser. No. 371,098 by Jones and Umphrey, the path of the borehole may be controlled by means of a deflection unit located in the drill string in relatively close proximity to the drill bit. FIG. 1 illustrates the application in the present invention in providing for a synchronized, pulsating flow of drilling fluid to a deflection unit of the type described in the Jones and Umphrey application. With reference to FIG. 1, there is shown a rotary drill system for drilling a borehole 10 through a coal seam 12. The drilling operations are carried out utilizing a rotary drill bit 14 which is secured to the end of a drill string 15. The drill string comprises joints of drill pipe which are secured at the surface to a drill stem 16. The drill stem 16 is in turn rotatably mounted in a drill head 18 which is used to apply torque and axial thrust to the drill string. The torque and thrust may be applied by any suitable means such as a power swivel and hydraulic jack combination (not shown).

The drill string is provided with a deflection unit 20 which is used to control the directional advance of the hole. Deflection unit 20 may be employed in a number of ways as described in the Jones and Umphrey application, but in the embodiment shown is located in closed proximity to the drill bit and between the drill bit and a stabilizer unit 21. Stabilizer unit 21 may be of any suitable type comprised of one or more centralizers such as those disclosed in the aforementioned article by Cervik et al.

Figure 2:
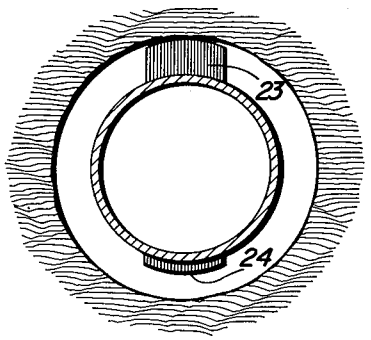
FIG. 2 is a sectional view taken along line 2—2 of FIG. 1
Figure 3:
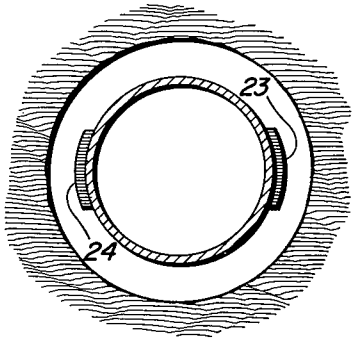
FIG. 3 is a view similar to FIG. 2, but showing the drill string rotated through an angle of 90° with respect to the position shown in FIG. 2.
Figure 4:
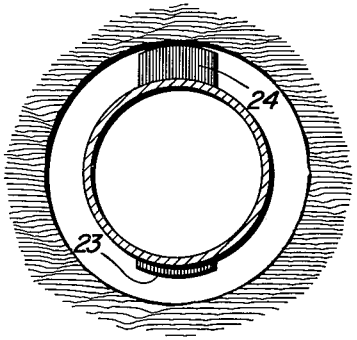
FIG. 4 is a view similar to FIG. 2, but showing the drill string rotated through an angle of 180° with respect to the position shown in FIG. 2.

The deflection unit comprises a pair of diametrically opposed deflection pads 23 and 24 which are cyclicly projected outwardly against the wall of the borehole and subsequently retracted in response to the pulsating flow of drilling fluid through the drill string 15. Thus, when the rate of flow of drilling fluid through the deflection unit 20 is at a designated "high" rate, pad 23 is projected outwardly against the wall of the borehole. When the flow rate is reduced to a "low" value, pad 23 is retracted and pad 24 is projected outwardly against the face of the borehole. The frequency of the pulsating fluid flow is equal to the rate of rotation of the drill string and is phased such that the deflection pads are projected outwardly at the angular displacement of the drill string which results in deflection of the bit in the desired direction. In the configuration illustrated in FIG. 1, the deflection unit is operated so that the pads are projected outwardly at the angular position of the drill string which is displaced 180° from the desired direction of deflection. Thus, in the configuration illustrated, it is desired to deviate the hole in a downward direction as viewed in the drawing and as shown in FIG. 1 and also FIG. 2, the flow rate through the drill string is at the high value, causing pad 23 to be in the projected position and pad 24 in the retracted position. As the drill pipe is rotated from the position shown in FIGS. 1 and 2, the flow rate is decreased. After rotational displacement of the drill string through an angle of 90° as illustrated in FIG. 3, pad 23 is returned to the retracted position. Upon further rotation of the drill pipe and decrease in the flow rate, pad 24 is moved outwardly until after an angular displacement of 180° from the position shown in FIG. 2, pad 24 is projected against the wall of the formation as illustrated in FIG. 4. At this point, the flow rate through the drill string is at the low value and with further rotation of the drill string it begins to increase until the drill string returns to the position shown in FIG. 2. For a more detailed description of the deflection unit and its use in controlling the directional advance of the borehole, reference is made to the aforementioned Jones and Umphrey application Ser. No. 371,098 which is incorporated herein by reference.

From the foregoing description it will be recognized that the pulsating flow of drilling fluid through the drill string is synchronized with rotation of the drill string so that the flow rate maxima and minima occur repeatedly at the same angular position of the drill string. In the system illustrated in FIG. 1, this is accomplished by generating a function representative of the rotational position of the drill string and responding to this function to repeatedly change the drilling fluid flow rate in phase with the desired rotational position of the drill string. The flow rate is changed by diverting a portion of the drilling fluid supplied to the drill string in synchronization with the designated rotational position of the drill string. Preferably the diverted portion of the drilling fluid is recirculated to the water tank or other drilling fluid source, from which it is pumped to the drill head.

More particularly and with continued reference to FIG. 1, the surface portion of the rotary drill system includes a primary supply line 27 through which drilling fluid is pumped to the drill head 18 from a suitable source such as tank 28. The system further includes signal means 30 associated with the drill stem 16 which generates a function representative of the rotational position of the drill stem. This function is applied to the actuator 32 of a valve 34 located in a secondary recirculation line 35. The actuator 32 thus acts to open and close the valve 34 in synchronization with the rotational position of the drill stem. While as described in greater detail hereinafter, this is accomplished by direct mechanical linkage through the action of a cam secured for rotation with the drill stem. It will be recognized that other suitable means can be employed. For example the angular position of the drill stem could be sensed by means of a sync pulse generator such as a magnetic pickup and an apropriate control signal then applied to the valve actuator.

In operation of the system illustrated in FIG. 1, drilling fluid is pumped under a suitable high pressure by means of pump 36 through the supply line to the drill head 18. As drill head 18 rotates the dril stem, a portion of the drilling fluid is diverted through the secondary line 35 and recirculated to the source tank 28. Where the valve 34 is operated between the fully closed and fully opened positions, the flow rate to the drill head 18 will vary in a sinusoidal format between a base flow rate (with the valve fully opened) and a maximum flow rate (with the valve closed) equal to the pump output.

Figure 5:
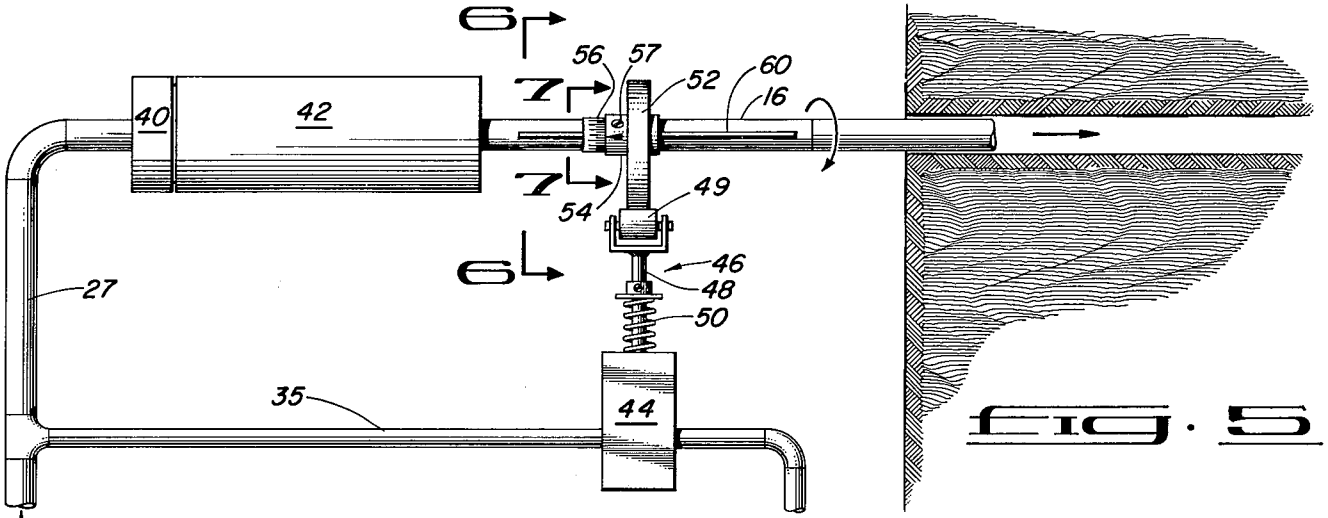
FIG. 5 is an illustration showing the surface equipment of a rotary drilling system embodying the present invention.

FIG. 5 illustrates an embodiment of the invention in which the flow rate through the secondary line is varied by means of a valve under control of a cam mounted on the drill stem. More particularly and as shown in FIG. 5 the drill head comprises a rear stationary swivel section 40 and a front power section 42 which functions to rotate and advance the drill stem 16. A gate valve 44 is located in line 35 and is equipped with a spring biased actuating assembly 46. Assembly 46 comprises an actuating rod 48 equipped with a roller 49 which rides on a cam member 52. The rod is biased to the upper position in which the valve is open by compression spring 50.

Figure 6:
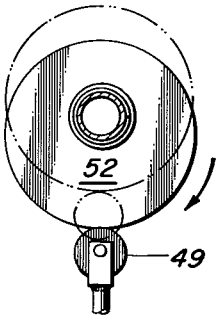
FIG. 6 is a sectional view taken along line 6—6 of FIG. 5.

Cam member 52 is eccentrically mounted on the drill stem 16 for rotation therewith as shown in FIG. 6. As shown in FIG. 5 and the enlarged view provided by FIG. 7, the cam member 52 includes an inner annular shoulder 54 which is mounted on an indexing sleeve 56 and secured to the sleeve by means such as a set screw 57. Indexing sleeve 56 is in turn secured against relative rotational movement with respect to drill stem 16 by a spline and keyway assembly 60. This assembly allows the drill stem to slide through the cam as the drill bit is advanced in the hole.

With the cam in the position shown in FIG. 5, the valve 44 is closed and the flow rate through line 27 to the drill head is at the maximum. Upon rotation of the cam member through an angle of 180° , the cam and actuating assembly will move to the position indicated by broken lines in FIG. 6 and the valve 44 will be in the open position. In this position the flow rate to the drill head is at the minimum value. It will be recognized from an examination of FIGS. 5 and 6 that the action of cam member 52 on roller 49 will open and close valve 44 during each complete revolution of drill stem 16.

The indexing sleeve 56 is provided with suitable indicia so that the cam 52 can be mounted on the drill stem at the necessary angular position to move the drill bit in the desired direction. The indexing sleeve also provides a means to compensate for torsional strain which may be induced in the drill string during the drilling operation. This strain, i.e. the amount of "twist" in the drill string, will vary depending upon the length of the drill string, the weight on the bit, and the rotational speed at which the system is operated.

Figure 7:
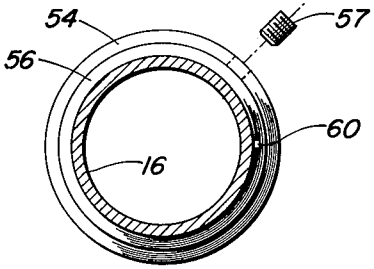
FIG. 7 is a sectional view taken along line 7—7 of FIG. 5.
Figure 8:
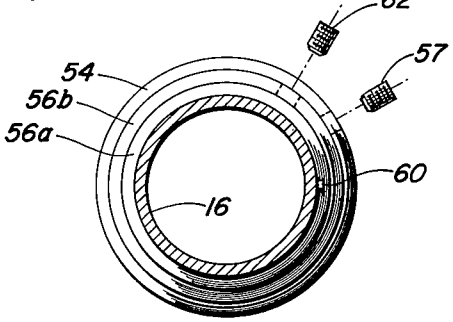
FIG. 8 is a sectional view similar to the view shown in FIG. 7, but of yet another embodiment of the present invention.

FIG. 8 is a cross-sectional view similar to FIG. 7 and illustrates a further embodiment of the invention in which two indexing sleeves are employed. One sleeve sets the cam at the desired directional adjustment, and the other provides compensation for torsional strain in the drill string. As shown in FIG. 8 a first indexing sleeve **56*a* is mounted on the drill stem 16 by means of spline and keyway assembly 60, similarly as described above. A second indexing sleeve 56*b* is adjustably secured to the first sleeve by means of a set screw 62 so that the two rotate together. Shoulder 54 is mounted on sleeve 56*b* and secured against relative rotational movement by means of set screw 57. In employing this embodiment of the invention, shoulder 54 can be set to the position on indexing sleeve 56*b* which provides for deflection of the drill bit in the desired direction. Sleeve 56*b* is in turn adjusted to the position on sleeve 56*a*** which compensates for the torsional strain induced in the drill string. Thus as the torque in the drill string varies during the drilling operation, suitable adjustments can be made without the driller having to take into account the directional adjustment as well.

Having described specific embodiments of the present invention, it will be understood that modifications thereof may be suggested to those skilled in the art, and it is intended to cover all such modifications as fall within the scope of the appended claims.

What is claimed is:

1. In the drilling of a borehole through a subterranean formation wherein a drilling fluid is circulated through a rotary drill string within said borehole and returned to the surface thereof through the borehole annulus surrounding said drill string, said drill string having a drill bit at the end thereof, and the directional advance of said drill bit is controlled by deflecting said drill string in response to pulsations in the flow of drilling fluid through said drill string, the improvement comprising synchronizing said pulsations in the flow of said drilling fluid with the rotation of said drill string by establishing a flow rate of said drilling fluid supplied to said drill string, generating a function represenatative of the rotational position of said drill string, and in response to said function repeatedly changing the flow rate of drilling fluid to said drill string in synchronization with a designated rotational position of said drill string while maintaining the flow of drilling fluid through said drill string in a constant direction.

2. The method of claim 1 wherein the flow rate of said drilling fluid is changed by diverting a portion of the drilling fluid supplied to said drill string in synchronization with said designated rotational position of said drill string.

3. The method of claim 2 wherein said drilling fluid is pumped to said drill string under a high pressure from a source of drilling fluid, and the diverted portion of said drilling fluid is recirculated to said source.

* * * * *